US007930976B2

(12) United States Patent
Kellett et al.

(10) Patent No.: US 7,930,976 B2
(45) Date of Patent: Apr. 26, 2011

(54) SLOW BURNING, GASLESS HEATING ELEMENTS

(75) Inventors: Richard M. Kellett, Longmeadow, MA (US); Carl F. Mallery, Jr., Simsbury, CT (US); Robert B. Korcsmaros, New Hartford, CT (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 176 days.

(21) Appl. No.: 11/832,845

(22) Filed: Aug. 2, 2007

(65) Prior Publication Data

US 2009/0031911 A1 Feb. 5, 2009

(51) Int. Cl.
*C06C 7/00* (2006.01)

(52) U.S. Cl. ..... 102/275.9; 102/275.11

(58) Field of Classification Search ..... 102/275.9, 102/275.1, 275.3, 275.5, 275.6, 276, 277.1, 102/277.2, 205, 202.1, 275.8, 275.11, 277; 149/108.6

See application file for complete search history.

(56) References Cited

U.S. PATENT DOCUMENTS

| | | | | |
|---|---|---|---|---|
| 3,086,894 | A | 4/1963 | Baggett et al. | |
| 3,111,396 | A * | 11/1963 | Ball | 264/628 |
| 3,319,520 | A | 5/1967 | Stefano et al. | |
| 3,430,564 | A | 3/1969 | Silvia et al. | |
| 3,503,814 | A | 3/1970 | Helms et al. | |
| 3,509,822 | A | 5/1970 | Rice et al. | |
| 3,730,093 | A * | 5/1973 | Cummings | 149/15 |
| 3,768,409 | A | 10/1973 | Menz et al. | |
| 4,053,337 | A * | 10/1977 | Collins | 149/37 |
| 4,349,612 | A * | 9/1982 | Baldi | 149/15 |
| 4,429,632 | A * | 2/1984 | Yunan | 102/202.5 |
| 4,696,231 | A * | 9/1987 | Bryan | 102/202.5 |
| 4,815,386 | A * | 3/1989 | Dillard et al. | 149/15 |
| 5,031,538 | A * | 7/1991 | Dufrane et al. | 102/275.11 |
| 5,046,425 | A * | 9/1991 | Gibbons et al. | 102/275.9 |
| 5,182,417 | A * | 1/1993 | Rontey et al. | 102/275.11 |
| 5,495,819 | A * | 3/1996 | Marion | 149/41 |
| 5,547,715 | A | 8/1996 | Barbee et al. | |
| 5,843,538 | A | 12/1998 | Ehrsam et al. | |
| 6,006,671 | A * | 12/1999 | Yunan | 102/275.11 |

(Continued)

FOREIGN PATENT DOCUMENTS

DE 102006001838 7/2007

(Continued)

OTHER PUBLICATIONS

Miziolek, Andrzej: "Nanoenergetics: An Emerging Technology Area of National Importance", The Amptiac Newsletter, vol. 6, No. 1, Spring 2002.

(Continued)

*Primary Examiner* — Michael Carone
*Assistant Examiner* — Jonathan C Weber
(74) *Attorney, Agent, or Firm* — O'Shea Getz P.C.

(57) ABSTRACT

A structure includes a substrate of a first material and a second material coating at least a portion of the substrate, where the second material is different from the first material, where the first and second materials, upon being thermally energized, react with each other in an exothermic and self-sustaining alloying reaction that propagates from a first location within the structure along a travel path to a second location within the structure at a rate that depends upon one or more characteristics of the first and second materials.

7 Claims, 4 Drawing Sheets

U.S. PATENT DOCUMENTS

| | | | | |
|---|---|---|---|---|
| 6,010,610 | A | 1/2000 | Yih | |
| 6,170,398 | B1 | 1/2001 | Rabotinsky et al. | |
| 6,863,992 | B2 * | 3/2005 | Weihs et al. | 428/607 |
| 6,886,327 | B1 | 5/2005 | Nathal et al. | |
| 7,383,775 | B1 * | 6/2008 | Mock et al. | 102/363 |
| 2005/0067072 | A1 * | 3/2005 | Vavrick | 149/37 |
| 2005/0142404 | A1 | 6/2005 | Boucher et al. | |

FOREIGN PATENT DOCUMENTS

| | | |
|---|---|---|
| GB | 2224729 | 5/1990 |
| WO | 9424074 | 10/1994 |
| WO | WO 2004/106268 | 12/2004 |
| WO | 2006086274 | 8/2006 |
| WO | WO 2007/095303 | 8/2007 |

OTHER PUBLICATIONS

Fischer et al.: "A Survey of Combustible Metals, Thermites and Intermetallics for Pyrotechnic Applications", Joint Propulsion Conference and Exhibit, Jul. 1-3, 1996.

Fischer et al.: "Theoretical Energy Release of Thermites, Intermetallics, and Combustible Metals", 24th International Pyrotechnics Seminar, Jul. 1998.

Sigmund Cohn Corp.: "Pyrofuze", www.sigmundcohn.com.

Reactive NanoTechnologies: "RNT NanoFoil product", www.rntfoil.com.

Ashby et al. "Metal Foams: A Design Guide", pp. 1-5 and 194-199, Butterworth Heinemann Publishers, 2000.

* cited by examiner

SLOW BURNING, GASLESS HEATING ELEMENTS

GOVERNMENT RIGHTS

This invention was made with Government support under contract W909MY-06-C-0041 awarded by the U.S. Army. The Government has certain rights in this invention.

BACKGROUND OF THE INVENTION

The invention relates in general to heat generating structures, and more particularly to a relatively slow burning, gasless heating element that may be utilized for various purposes such as a delay element or fuse that ignites an explosive device or material.

It is known that a heat generating structure composed of two dissimilar materials such as metals may be used as an ignitable delay element or fuse. The delay element may be used in varied applications to safely initiate the timed ignition or detonation of an explosive device or material. These heat generating structures can come in many different physical forms. For example, known ignitable delay elements comprised of compressed powder mixtures can be unreliable and exhibit unacceptable delay timing (e.g., timing differences between similarly manufactured elements) or initiation-sensitive variations. These problems are due, for example, to particle size distribution inconsistencies, inadequate mixing, free volume and pressure. In addition, such an undesirable performance variation tends to become more pronounced as the propagation rate of the delay element is reduced. Further, powder-type delay mixtures produce at least some gas, the production of which requires the incorporation of hardware structures that prevent the premature and undesired heating and possible ignition of the "target" (the substance, often an explosive, which ignites when the delay has run its course or completed its propagation) by such hot gas production. Also, the production of such gases by these powder mixtures is oftentimes influenced by pressure and packing variations.

Other known heat generating structures that can be used as delay elements include that which is commercially available under the brand name Pyrofuze® provided by the Sigmund Cohn Corporation of Mount Vernon, N.Y. This device comes in wire or ribbon form and comprises two metallic elements in intimate contact with one another: an inner core of aluminum surrounded by an outer jacket of palladium. When the two metallic elements are brought to the initiating temperature by a sufficient amount of heat, the metals react by alloying rapidly resulting in instant deflagration without support of oxygen. Once the alloying reaction is started, the reaction will not stop until alloying is completed. One drawback with the Pyrofuze® delay element is that it typically burns at a relatively rapid rate.

Another commercially available heat generating structure that can be used as a delay element or fuse is provided under the brand name NanoFoil® by Reactive NanoTechnologies, Inc. of Hunt Valley, Md. The NanoFoil® device is a multilayer foil comprised of thousands of alternating nanoscale thin layers of aluminum and nickel. When initiated by an electrical, thermal, mechanical or optical source, the metals will mix or alloy and react to release heat energy. However, when used as a delay element or fuse, the NanoFoil® multilayer foil tends to have a burn rate that is relatively fast, and the burn rate is not easily variable. The NanoFoil® multilayer foil is also relatively expensive.

What is needed is a relatively slow burning, gasless, heat generating structure composed of two or more dissimilar materials, such as metals, distributed in a non-uniform three-dimensional manner along its propagation or burn path, where the structure when ignited exhibits an exothermic alloying reaction between the materials and can function as a delay element or fuse in providing for reliable propagation and, thus, accurate ignition of an explosive device.

SUMMARY OF THE INVENTION

According to an aspect of the invention, a heat generating structure includes a substrate comprised of a first material and a second material coating at least a portion and preferably all of the first material, where the second material is different from the first material, where the materials, upon being thermally energized, react with each other in an exothermic and self-sustaining alloying reaction that propagates from a first location within the structure along a travel path to a second location within the structure at a rate that depends upon one or more characteristics of the first and second materials.

The present invention is predicated on that fact that the exothermic reaction between the dissimilar materials comprising the heat generating structure can be made to occur at a relatively slower propagation or burn rate than prior art devices in part not only due to the composition of the dissimilar materials selected but also due to the three-dimensional characteristics of the substrate portion of the structure; in particular, to a non-uniform and varying distribution of the mass of the substrate and corresponding coating along the direction of the propagation or burn path. These three-dimensional characteristics result in the transmission of heat into a structure comprising a substrate with a network of many different burn or propagation directions at one or more instants in time, in addition to the propagation direction along the desired burn path. As described in detail hereinafter, such a substrate with a network of many different propagation directions can be achieved, for example, by a mesh or foam structure.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
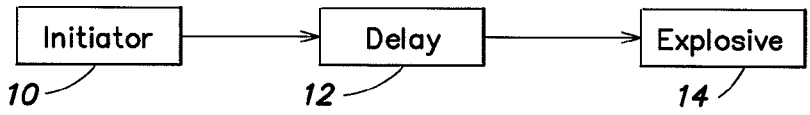
FIG. 1 is a block diagram of a delay element used between an initiator device and an explosive material or device.

Referring to FIG. 1, a simplified block diagram illustrates an initiator device 10 connected with a delay element or fuse 12, which itself is connected with an explosive material or device 14. The explosive device 14 may comprise any type of explosive device or material designed to detonate to achieve a desired purpose. The delay element or fuse 12 allows one to initiate the timing of the detonation of the explosive device after a predetermined amount of time following initiation of the delay element using the initiator device 10. The initiator device 10 may be any type of device that provides for initiation of propagation or burning of the delay element 12; for example, the initiator device 10 may comprise an electrical, thermal, mechanical, optical or other device.

Figure 2:
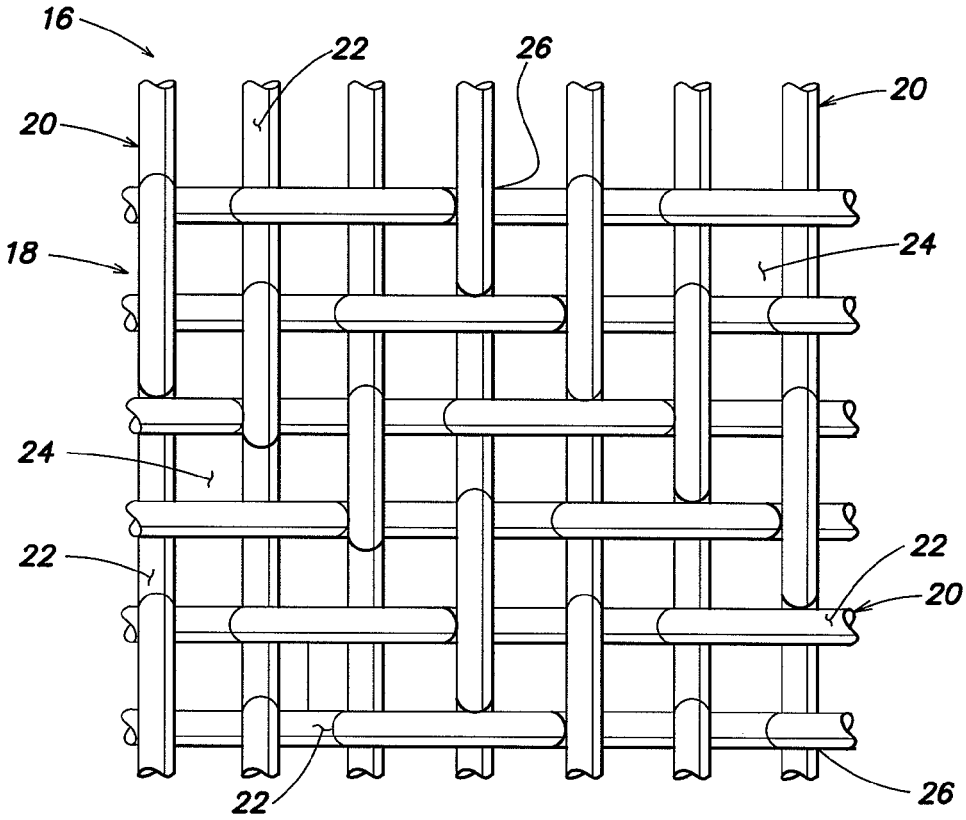
FIG. 2 is a top view of a mesh substrate having a plurality of wires each coated with a material in an embodiment of a heat generating structure of the present invention.

Referring to FIG. 2, there illustrated is a top view of a preferred embodiment of a heat generating structure 16 in accordance with the present invention. The structure may comprise at least two constituent portions: a substrate 18 comprised of a plurality of wires 20 of one material, preferably a reactive metal, where the substrate 18 is preferably continuous or contiguous in all three dimensions; and a coating 22 of a second material, preferably also a reactive metal that is different from the metal comprising the wires 20. The coating 22 is applied on at least a portion of each substrate wire 20 and preferably, on the entirety of each substrate wire 20, to thereby form a substrate 18 of continuously-coated wires 20. Preferably, the three-dimensional structure of the substrate 18 is such that it has an appreciable amount of free volume (i.e., empty air space creating voids 24 between crossing wires 20 in the mesh substrate 18). Thus, in FIG. 2 the substrate 18 is preferably a continuous mesh structure that comprises a plurality of intersecting straight metal wires 20 with voids or empty spaces 24 located between intersecting wires 20. The wires 20 are preferably in intimate physical and, thus, thermal contact with one another at the intersections 26. In an exemplary preferred embodiment, the mesh substrate 18 is commercially available from TWP, Inc. of Berkeley, Calif., and comprises a plurality of aluminum wires 20 each with an approximate thickness or diameter in the range of from 0.0021 inches (200 wires per inch) to 0.0090 inches (40 wires per inch).

In a preferred embodiment, the coating 22 comprises nickel that is applied onto the outer surface of each of the wires 20 of the aluminum metal mesh substrate 18 by, for example, electroplating or other methods such as vacuum sputtering or through an electroless process. The nickel coating 22 may include other materials including boron, phosphorus and/or palladium. Also, if aluminum is utilized as the mesh substrate material, any aluminum oxide that is present on the outer surface of the aluminum wires 20 may be removed and a coating of zinc may be applied to the outer surface of the wires 20. The zinc may allow initiation or ignition of the structure 16 at a lower temperature than if the zinc were not present. In the alternative, the zinc coating may be removed if an electroless process is used to coat the nickel onto the aluminum wire 20. The amount of nickel that is coated onto the aluminum mesh wires 20 may be in a one to one ratio with the underlying aluminum wires 20; that is, the nickel may be in an equivalent molar content as that of the aluminum. The heat generating structure 16 may be considered to be a reactive multilayer laminate comprising the substrate 18 and the coating 22, with both the substrate 18 and the coating 22 comprising reactive metals in a preferred embodiment.

Figure 3:
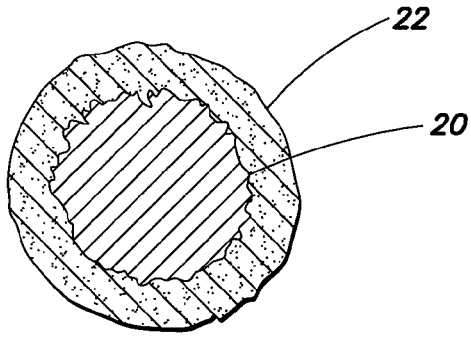
FIG. 3 is a cross-section of one of the wires in the mesh substrate of FIG. 2.

FIG. 3 illustrates a cross section of one of the aluminum wires 20 in the mesh with a nickel coating 22 in a one to one ratio. Here, the approximate thickness of the nickel coating 22 may be 600 micro inches. If a combination of nickel and palladium is coated onto the aluminum wires 20 in the mesh substrate 18, the approximate thickness of the nickel coating may be 100 micro inches and that of the palladium may be 300 micro inches. In the alternative, the ratio between the aluminum and nickel may be something other than one to one, for example, a ratio of one to three. In general, the thickness of the coating 22 is selected so as to control the alloying stoichiometry and, thus, the rate of heat evolution and propagation.

The materials (e.g., metals) comprising the substrate 18 and the coating 22 are selected based on their individual characteristics, such as melting point and density, and in combination for enthalpy of alloying. For any bimetallic structure comprising a substrate of a first metal coated with a second, different metal to propagate, the formation of alloys from the individual metal constituent components must be exothermic. This heat evolved warms not only the surrounding environment, but also the continuous metal structure. After a source of ignition (e.g., a match or heating element) is applied to the structure 16 of the present invention, the alloying temperature of at least one of the metals (typically that of the aluminum wire 20 first) is eventually achieved and the materials are thermally energized and react with each other such that further alloying between the two metals is induced. Accordingly, heat is liberated with resulting propagation in a self-sustaining manner throughout the entire continuous heat generating structure 16 from a first or starting point within the structure and along a travel path to a second or ending or discharge point within the structure, and preferably in a controlled and repeatably manufacturable manner. The starting and ending points are typically spaced from each other with the travel path in between.

For example, if the structure is of a three-dimensional, rectangular-shape, once ignited at a first or starting end of the structure 16, the thermal energization of the reactive materials comprising the structure will cause the propagation to continue through to the second or discharge end at a consistent timed rate depending on the intermetallic or bimetallic (or non-metallic) composition of the structure 16 as well as on the geometric configuration (e.g., thickness of wires 20, wire crossing frequency) of the structure 16. Located at the second end of the structure 16 is some type of explosive device or material (e.g., fireworks, blasting caps, etc.) that is ignited when the propagation reaches this second end of the structure. Thus, by controlling the composition and the configuration of the reactive materials comprising the heat generating structure 16, the burn or propagation rate can be controlled (that is, the reaction rate or time period for propagation from the first end to the second end along the travel path of the reactive material can be selected).

More specifically, the exothermic reaction between the dissimilar materials comprising the heat generating structure 16 can be made to occur at a relatively slower propagation or burn rate than prior art devices in part not only due to the composition of the dissimilar materials selected but also due to the three-dimensional characteristics of the substrate portion 18 of the structure; in particular, to a non-uniform and varying distribution of the mass of the substrate and corresponding coating along the direction of the primary propagation or burn path. For example, if the mesh structure 16 of FIG. 2 were ignited by initially igniting the seven vertical wires 20 illustrated at the top of FIG. 2 and then moving downward (along the primary burn path), the burning or propagation of these wires would continue downward at a relatively fast rate until the first horizontal cross wire 20 was encountered by each of the vertical wires 20. At these intersection points 26, the rate of propagation would slow somewhat due to the relatively greater mass encountered by the horizontal and vertical crossing wires 20 which are preferably in close physical and, thus, thermal contact with one another. Burning and propagation would travel along this horizontal wire 20 in addition to continuing to travel downward in a vertical direction in FIG. 2. Essentially, at these wire intersections 26 a non-uniform and varying distribution of mass of the substrate 18 is encountered by the burning vertical wires 20, which inherently slows down the propagation or burn rate of the entire wire mesh substrate 18. Once propagation has reached the first horizontal wire, heat liberated from the alloying of the horizontal wire 20 then accelerates propagation. The propagation rates speed up until the next horizontal wire 20 is encountered, where the propagation rate slows again. This process repeats itself until the wire mesh substrate 18 has been entirely burned through.

Figure 4:
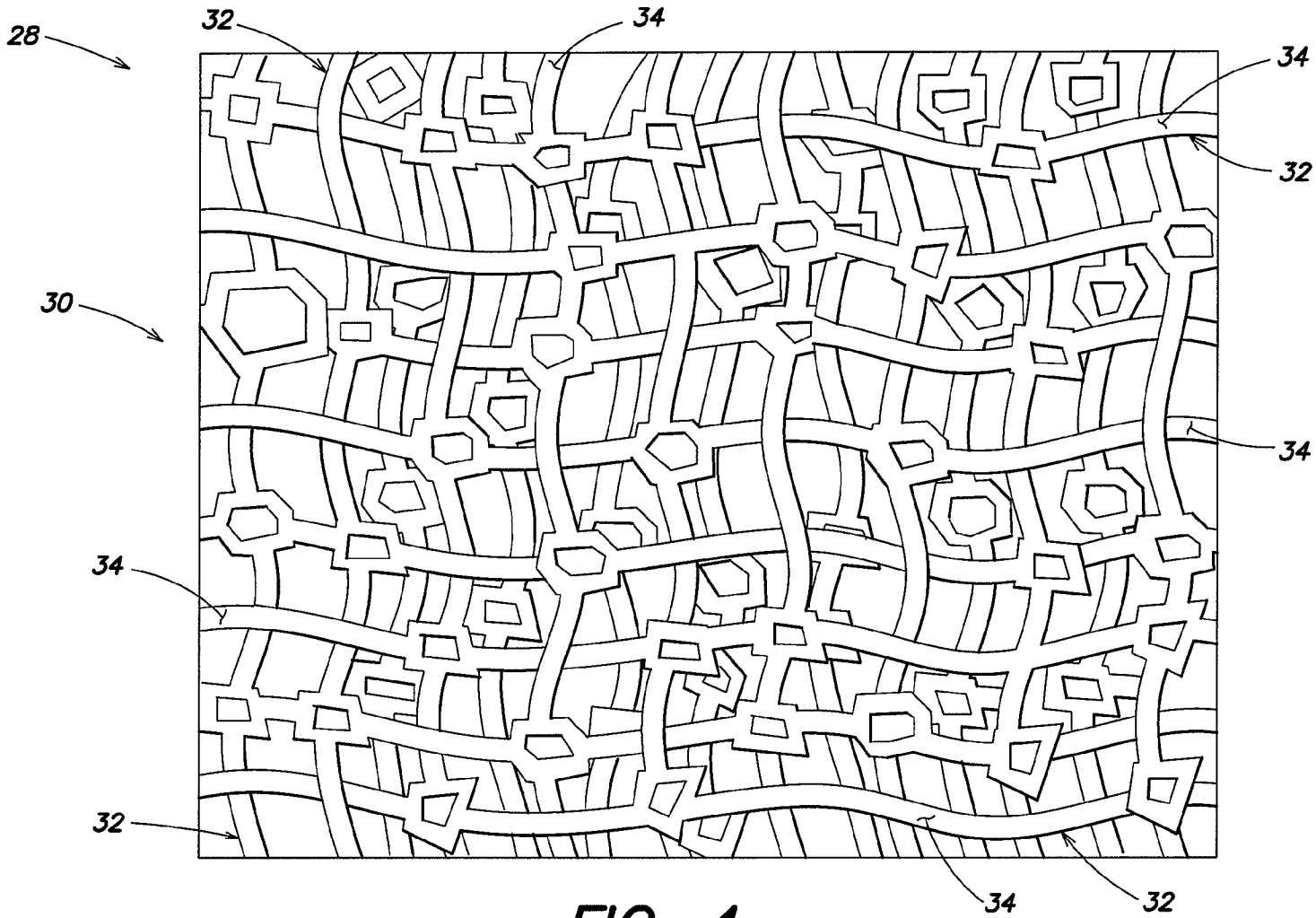
FIG. 4 is a side view of an alternative embodiment of a foam substrate of the heat generating structure of the present invention.

Referring to FIG. 4, there illustrated is an alternative embodiment of the heat generating structure 28 of the present invention in which the substrate 30 comprises a foam. As compared to the mesh substrate 18 of FIG. 2, the foam substrate 30 of FIG. 4 contains many more wires 32 going off in many more different directions at one or more instants in time. The foam substrate 30 may be that commercially available from ERG Materials and Aerospace Corp. of Oakland, Calif., and may comprise an aluminum foam which includes approximately 7% by volume, with approximately forty pores per inch. The majority of the wire filaments 32 comprising the foam substrate 30 are preferably less than 0.02 inches in diameter. In an exemplary preferred embodiment, the foam substrate 30 may be electroplated or coated with an equivalent molar content of nickel, thereby reducing the free volume of the foam to approximately 88%. However, the molar content of the nickel coating 34 may be anywhere in the range of 70% to 150% of the molar content of the aluminum. The foam substrate 30 may be coated in a similar manner as that of the mesh substrate 18 of FIG. 2 described hereinabove.

The three-dimensional characteristics of the heat generating structure of the present invention result in the transmission of heat into a structure comprising a substrate with a network of many different burn or propagation directions at one or more instants in time, in addition to the propagation direction along the desired burn path. This is particularly true with respect to the foam substrate 30 as compared to the mesh substrate 18 in terms of the number of different burn or propagation directions at one or more instants in time. Unlike systems based on compacted powder, the continuous nature of the mesh substrate 18 or foam substrate 30 and the intimate contact between the metal coating the substrates eliminates the pressure dependency required for intimate contact between layers. Thus, the burn rate of the structure is less dependent upon pressure. Failures are also reduced as a consequence of the many filaments and intersections inherent in the substrates 18, 30. In addition, consistency is enhanced since the exothermicity is controlled by the content of the metals, which content is, in turn, characterized by easily measurable and controllable weights and thicknesses (i.e., a composition and a configuration).

In general, any material that can be prepared or formed as a foam substrate 30, a mesh substrate 18, or other non-completely-solid substrate may be used as the substrate. This includes various metals and non-metals. In a preferred embodiment, the substrate material comprises aluminum and the coating comprises nickel coated that is either pure or combined with boron and/or phosphorus. The material comprising the substrate is typically selected in accordance with or in dependence on the material that will be coated onto the substrate. The material coated onto the substrate is preferably deposited in a reliable and consistent manner, for example by electrochemical means such as electroplating or by an autocatalytic electroless process. The materials that may comprise the substrate wires and/or the wire coating may include those from the group of reactive metals including aluminum, boron, carbon, silicon, zirconium, iron, copper, beryllium, tungsten, hafnium, antimony, magnesium, molybdenum, zinc, tin, nickel, palladium, phosphorus, sulfur, tantalum, manganese, cobalt, chromium, and vanadium.

Also, metal particles such as aluminum, magnesium, boron, beryllium, zirconium, titanium, zinc may be used in combination with fluoropolymers such as polytetrafluoroethylene, fluoroelastomers, fluorosurfactants, or fluoroadditives. As such, the metals may be formed in finely divided particles within a matrix of one of the polymers and extruded to form a wire-like structure such as a filament which is then integrated into the structure of the substrate (e.g., the wire mesh substrate 18 of FIG. 2). In the alternative, a tube made from, e.g., aluminum, may be filled with the above noted metal particles mixed in with one of the above noted polymers. A plurality of such tubes may then be used to form the substrate. Additional materials that may be utilized include energetic polymers and plasticizers such as glycidyl azide polymer, polyoxetanes, or polyglycidyl nitrate. These materials may be used alone as the substrate material or in combination with any of the above reactive metals or non-reactive metals, for example, by forming these polymers and plasticizers around the metals in a wire-like structure which is then integrated into the structure of the substrate (e.g., the wire mesh substrate 18 of FIG. 2). Again, these energetic materials may be used either alone or in combination with any of the above reactive or non-reactive metals by placing them inside of an aluminum tube and having a plurality of such tubes comprise the substrate.

Further, the following non-energetic polymers can be combined with any of the above materials to form the substrate: hydroxy terminated polybutadiene, hydroxy terminated polyether, carboxy terminated polybutadiene, polyether, polycaprolactone, or polyvinyl chloride. Alternatively, such a combination of non-energetic polymers can be placed inside of an aluminum tube, where a plurality of such tubes comprise the substrate. In addition, there exist many powder-based reactions composed of a fuel and an oxidizer that constitute the bulk of pyrotechnic formulations. Incorporating these into the heat generating structure of the present invention necessitates the use of a binder material, such as the energetic polymers and plasticizers listed above or the non-energetic polymers listed above, together with a non-reacting metal wire material.

Figure 5:
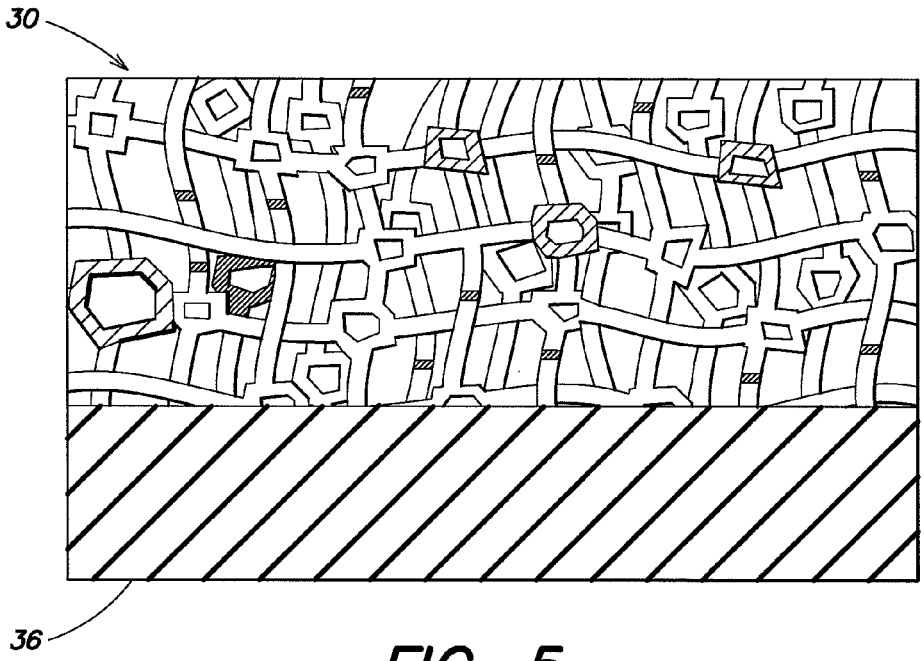
FIG. 5 is a sectional view of the foam substrate of FIG. 4 located on another substrate.

Referring to FIG. 5, in accordance with yet another embodiment of the heat generating structure of the present invention, the mesh substrate 18 of FIG. 2 or the foam substrate 30 of FIG. 4 may include a second substrate 36 that is in contact with the mesh or foam substrate of the heat generating structure. In FIG. 5, the foam substrate 30 is illustrated as being applied on top of or, in the alternative, within, the second substrate 36. The second substrate 36 may comprise, for example, an insulating material that is utilized to retain the heat generated during the alloying process. The insulating material of the second substrate 36 may comprise a ceramic material or other material such as diatomaceous earth, silica, Aero-sil commercially available from Degussa in Germany, Cabosil commercially available from Cabot Corp. of Billerica, Mass., or a foamed ceramic commercially available from Aspen Aerogels, Inc. of Northborough, Mass. In the alternative, the second substrate 36 may comprise a conductive material.

Figure 6:
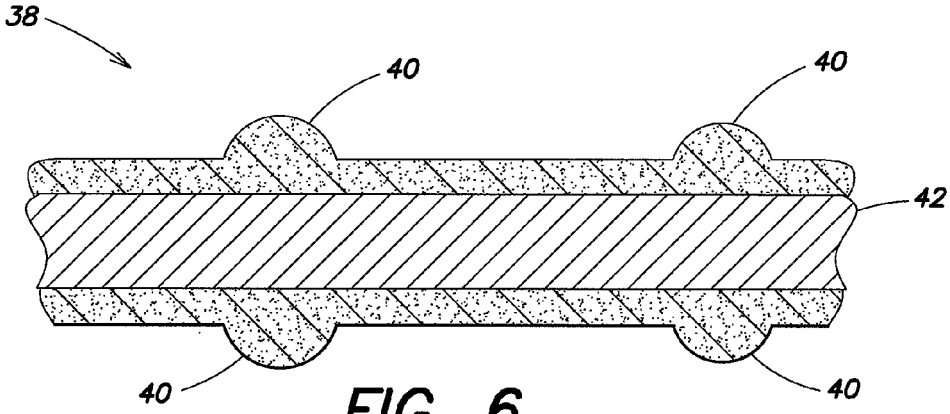
FIG. 6 is a cross-section of a portion of an alternative embodiment of a substrate having a non-uniform and varying distribution of mass along its length.
Figure 7:
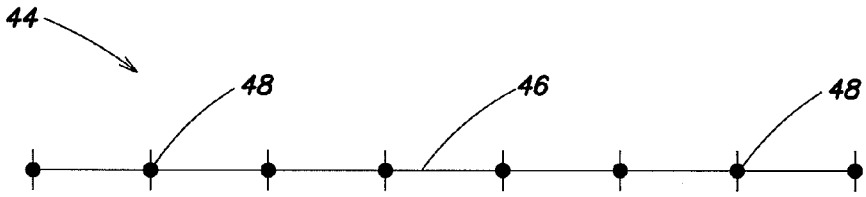
FIG. 7 is a top view of a portion of an alternative embodiment of a substrate having a non-uniform and varying distribution of mass along its length.

FIGS. 6-7 illustrate various different embodiments of a portion of a heat generating structure in accordance with the present invention. Each embodiment has a non-uniform distribution of mass along its propagation length. Most often this non-uniform distribution of mass is larger in size than most of the remaining length of the structure. This has the effect of slowing down the propagation rate or burn rate of the structure each time the non-uniform, larger mass is encountered along the propagation or burn path of the overall structure. FIG. 6 illustrates a "knots on a rope" structure 38 in which the coating material 40 is non-uniformly distributed on a cylindrical substrate 42. In the alternative, the substrate may not be cylindrical but may be of non-uniform distribution as well. FIG. 7 illustrates a "train track" structure 44 in which a straight horizontal wire 46 representing the propagation or burn path has a series of "crossing" tracks or wires 48.

Figure 8:
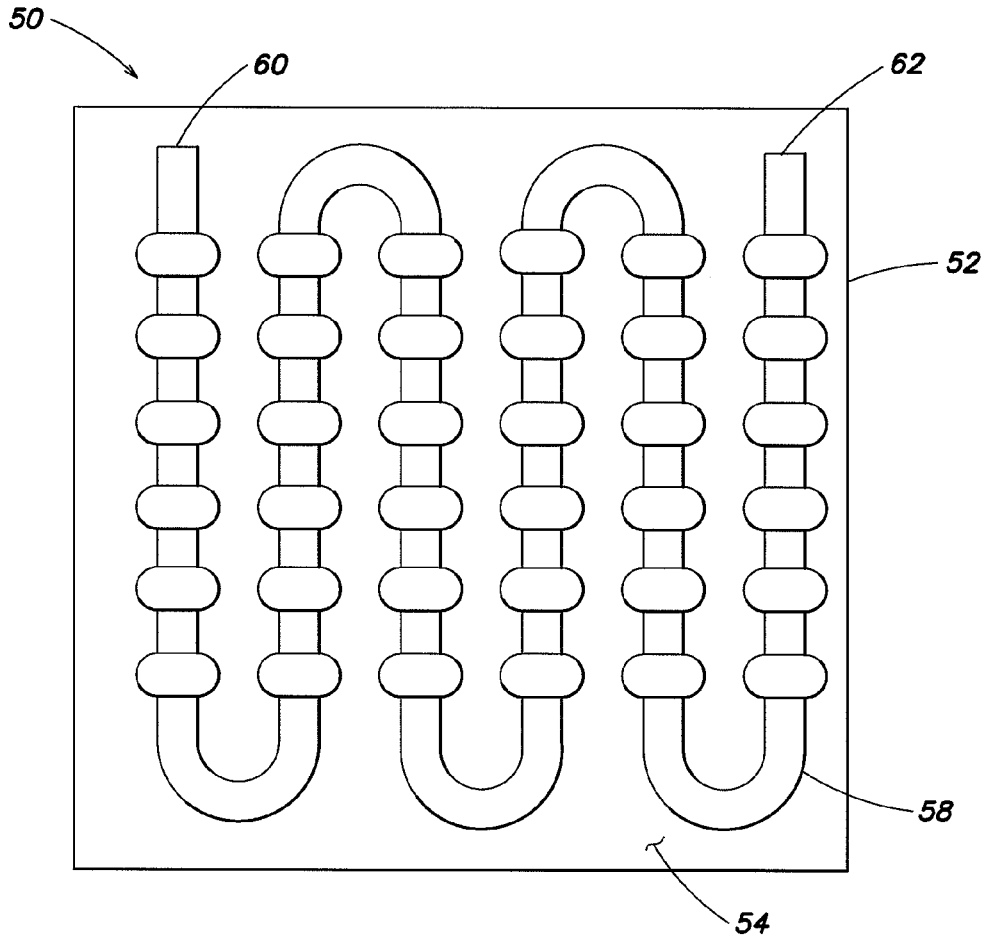
FIG. 8 is a top view of an alternative embodiment of a heat generating structure of the present invention.
Figure 9:
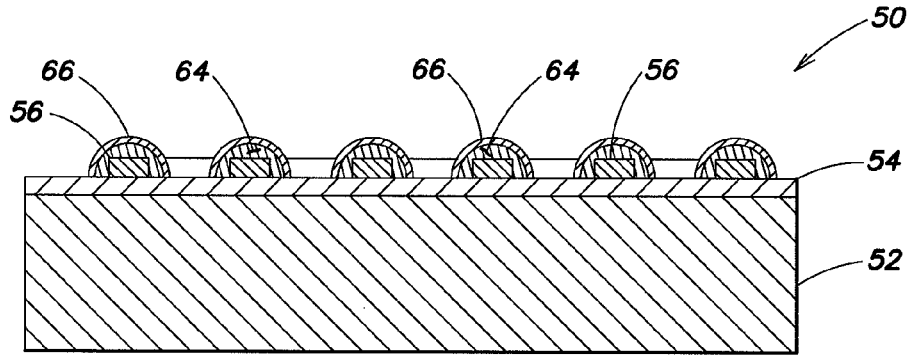
FIG. 9 is a cross-section of the embodiment of the heat generating structure of FIG. 8.

Referring to FIGS. 8-9, there illustrated is yet another embodiment of a heat generating structure 50 of the present invention comprising a substrate 52 such as a circuit board which is at least partially insulating and may be flexible to allow the structure 50 to be rolled up. Preferably applied to the entire upper surface of the substrate 52 is a thin layer 54 of a conductive material. On a surface of the conductive layer 54 may be applied an optional thin layer 56 of a conductive material such as silver, copper or carbon, in a serpentine or other pattern 58. The pattern 58 has a starting point 60 at one end and an ending or discharge point 62 at a second end. Located on top of the layer of thin conductive material layer 56 is an inner layer 64 of, e.g., aluminum, which may be applied by a non-aqueous electroplating process such as that provided by AlumiPlate, Inc. of Minneapolis, Minn. Applied to the inner layer 64 is an outer layer 66 of, e.g., nickel, which may be applied by direct electroplating or by an electroless process. Other materials as discussed above may be utilized. The heat generating structure 50 of the embodiment of FIGS. 8-9 is similar to that of the structure 16 of FIG. 2 in that, when ignited, the aluminum and nickel combination propagates from the starting point 60 along a travel path (i.e., the serpentine or other pattern 58) to the end or discharge point 62 in a controlled manner. Thus, the heat generating structure 50 of the embodiment of FIGS. 8-9 functions as a delay element in a similar manner to the structures 16, 28 of FIGS. 2 and 4.

Although the present invention has been illustrated and described with respect to several preferred embodiments thereof, various changes, omissions and additions to the form and detail thereof, may be made therein, without departing from the spirit and scope of the invention.

What is claimed is:

1. An initiation system, comprising: an initiator device; and a structure that includes a substrate comprised of a first material, wherein said substrate is in the form of a mesh or a foam; and a second material coating at least a portion of the substrate, where the second material is different from the first material; wherein the first and second materials, upon being thermally energized by the initiator device, react with each other in an exothermic and self-sustaining alloying reaction that propagates from a first location within the structure along a travel path to a second location within the structure and at a rate that depends upon one or more characteristics of the substrate and the coating.

2. The system of claim 1, where the first material comprises aluminum and the second material comprises nickel.

3. The system of claim 1, where the first and/or second materials are from the group that comprises aluminum, boron, carbon, silicon, zirconium, iron, copper, beryllium, tungsten, hafnium, antimony, magnesium, molybdenum, zinc, tin, nickel, palladium, phosphorus, sulfur, tantalum, manganese, cobalt, chromium, or vanadium.

4. The system of claim 1, further comprising a second substrate that is an insulating material.

5. The system of claim 1, where the first and/or second materials further comprise a material from the group that comprises glycidyl azide polymer, polyoxetanes, or polyglycidyl nitrate.

6. The system of claim 1, where the first and/or second materials further comprise a material from the group that comprises hydroxy teiminated polybutadiene, hydroxy terminated polyether, carboxy terminated polybutadiene, polyether, polycaprolactone, or polyvinyl chloride.

7. An initiation system, comprising: an initiator device; and a structure that includes a substrate comprised of a first material arranged in a non-uniform and varying distribution of mass of the first material along a length of the substrate in a propagation direction; and a second material coating at least a portion of the substrate, where the second material is different from the first material; wherein the first and second materials, upon being thermally energized by the initiator device, react with each other in an exothermic and self-sustaining alloying reaction that propagates from a first location within the structure along a travel path to a second location within the structure at a rate that depends upon one or more characteristics of the substrate, where a physical configuration of the substrate includes one or more different directions of the first material at one or more points along the travel path.

* * * * *